US007127768B2

(12) United States Patent
Blum et al.

(10) Patent No.: US 7,127,768 B2
(45) Date of Patent: Oct. 31, 2006

(54) DISPOSABLE CLEANING HEAD

(75) Inventors: Lisa Blum, Pleasanton, CA (US); Russell Bell, Pleasanton, CA (US); Layfayette Foland, Pleasanton, CA (US); George Katsigras, Pleasanton, CA (US); Douglas Minkler, Pleasanton, CA (US); Sara Morales, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 10/663,496

(22) Filed: Sep. 12, 2003

(65) Prior Publication Data

US 2005/0055787 A1 Mar. 17, 2005

(51) Int. Cl.
*A47K 11/10* (2006.01)
*A47L 13/17* (2006.01)

(52) U.S. Cl. ..... 15/104.94; 15/209.1; 15/210.1; 15/244.1; 15/244.3; 15/229.11

(58) Field of Classification Search ..... 15/104.93, 15/104.94, 209.1, 210.1, 244.1, 244.2, 244.3, 15/244.4, 229.11, 229.12, 229.13
See application file for complete search history.

(56) References Cited

U.S. PATENT DOCUMENTS 1,497,079 A * 6/1924 Gullborg et al. ..... 15/244.2
1,577,944 A * 3/1926 Bennington ..... 15/244.1
1,994,939 A * 3/1935 Boulton ..... 15/121
2,221,128 A * 11/1940 Bates ..... 15/244.1
2,402,577 A * 6/1946 Rodgers ..... 15/210.1
2,752,625 A * 7/1956 Ponsell ..... 15/229.13
2,919,455 A * 1/1960 Turner ..... 401/9
3,081,479 A * 3/1963 Hanlon ..... 401/201
3,406,420 A * 10/1968 Siemund ..... 15/121
3,753,267 A * 8/1973 Johnson, Sr. ..... 15/210.1
3,798,700 A * 3/1974 Popeil ..... 15/228
3,820,187 A * 6/1974 Numbers et al. ..... 15/244.2
3,875,609 A * 4/1975 Wells ..... 15/210.1
4,613,446 A * 9/1986 Magyar ..... 15/104.93
4,793,019 A * 12/1988 Stima et al. ..... 15/104.94
5,003,659 A * 4/1991 Paepke ..... 15/229.13
5,593,460 A * 1/1997 Lessard ..... 15/143.1
5,941,379 A * 8/1999 Barardo ..... 206/209

FOREIGN PATENT DOCUMENTS

EP 1134282 * 9/2001
GB 2134775 * 8/1984
JP 2000-308600 * 11/2000
WO 00/71012 * 11/2000

* cited by examiner

*Primary Examiner*—Mark Spisich
(74) *Attorney, Agent, or Firm*—David Peterson

(57) ABSTRACT

A disposable cleaning head comprising a sponge, scrim and a one-piece flexible fitment having an engagement member adapted to removably engage a handle. Preferably, the scrim includes a cleaning composition having at least one surfactant. The cleaning composition can optionally include one or more bactericidal agents, bleaching agents, chelants, salts, coloring agents, fragrances and preservatives.

19 Claims, 12 Drawing Sheets

DISPOSABLE CLEANING HEAD

FIELD OF THE PRESENT INVENTION

The present invention relates generally to cleaning pads and related systems for cleaning surfaces. More particularly, the invention relates to a disposable cleaning head containing a cleaning composition suitable for cleaning toilet bowls and the like.

BACKGROUND OF THE INVENTION

Cleaning a toilet bowl is typically one of the most undesirable jobs for most persons. Nevertheless, toilet bowls must be kept clean in order to prevent sanitary problems, the potential for irritable smells, and the possibility of harmful bacteria buildup.

As a result, various types of bowl cleaning products are known. Such products typically fall within two categories, namely, cleaning by hand with a bowl cleaner or with automatic "in tank" or "in bowl" cleaners. Hand cleaning typically takes the form of a toilet cleaning brush or sponge. Such devices, however, are displeasing due to the excessive dripping therefrom and because storage between uses is unsanitary. Further, there is no premeasured dosage with current bowl cleaning products. Most users just estimate the amount to use and potentially could use too little and thus not achieve a disinfectant level, or too much, which increases the cost per application. Additionally, bowl cleaning products are very toxic and present a potential safety hazard.

Automatic "in tank" or "in bowl" cleaners, which dispense a dosage upon flushing of the toilet, generally are not as effective as manual scrubbing. Therefore most consumers typically supplement such automatic cleaners with hand scrubbing and cleaning. In addition to often ineffective cleaning, "in tank" or "in bowl" cleaners have other disadvantages. For example, "clear water" types of cleaners give no indication when they are used up and need changing, and having to place one's arm into a toilet bowl and/or tank to retrieve spent containers is also unpleasant and undesirable. Further, the "blue water" products are, in many instances, only cosmetic and, at best, merely add a small amount of surfactant to the water.

Numerous types of cleaning compositions, as well as holders for disposable cleaning pads, are known in the art. Illustrative are the compositions and apparatus disclosed in U.S. Pat. Nos. 4,852,201, 4,523,347, 4,031,673, 3,413,673 and 3,383,158.

In the '201 patent, a toilet bowl cleaner is disclosed having a handle with a removable cleaning pad disposed on one end. The toilet bowl cleaner also includes a cleaning solution that is contained in the pad.

There are numerous disadvantages associated with the disclosed toilet bowl cleaner. First, the pad is substantially rigid and thus can not conform to the various curvatures of a toilet bowl. Second, the pad release mechanism requires a user to directly contact the used pad to remove and replace the pad. Finally, the pad is restrained to one plane of rotation by virtue of a mechanical joint.

It is therefore an object of the present invention to provide a disposable cleaning head that overcomes the disadvantages and shortcomings associated with prior art cleaning heads, pads and systems.

It is another object of the invention to provide a disposable cleaning head that substantially enhances the effectiveness of cleaning a toilet bowl as compared to prior art brush and sponge systems.

It is another object of the invention to provide a disposable cleaning head that substantially reduces the time associated with cleaning a toilet bowl.

It is another object of the invention to provide a disposable cleaning head that is readily engageable to and releasable from a variety of handles.

It is another object of the invention to provide a disposable cleaning head that is readily engagable to and releasable from a variety of handles without the necessity of direct user contact with or handling of the cleaning head.

It is another object of the invention to provide a disposable cleaning head that includes a flexible fitment that facilitates bending in multiple planes and rotation of the cleaning head relative to the handle without the necessity of a mechanical joint.

It is another object of the invention to provide a disposable cleaning head that includes a pre-determined amount of cleaning composition that effectively cleans and disinfects a toilet surface.

It is yet another object of the invention to provide a disposable cleaning head having sufficient flexibility to maintain optimum surface contact during use on curved surfaces and/or constrained toilet bowl regions.

SUMMARY OF THE INVENTION

In accordance with the above objects and those that will be mentioned and will become apparent below, in one embodiment of the invention, the disposable cleaning head comprises a sponge, scrim and a one-piece flexible fitment having an engagement member adapted to removably engage a handle. Preferably, the scrim includes a cleaning composition having at least one surfactant. The cleaning composition can optionally include one or more bactericidal agents, bleaching agents, chelants, salts, coloring agents, fragrances and preservatives.

In a further embodiment of the invention, the disposable cleaning head comprises a scrim and a one-piece flexible fitment having an engagement member that is similarly adapted to removably engage a handle. Preferably, the scrim includes a cleaning composition having at least one surfactant.

In another embodiment of the invention, the disposable cleaning head comprises a sponge and a one-piece flexible fitment having an engagement member adapted to removably engage a handle, the engagement member similarly including non-mechanical articulating means to facilitate rotation of the cleaning head relative to the handle. Preferably, the sponge includes a cleaning composition having at least one surfactant.

In another embodiment of the invention, the disposable cleaning head comprises a flexible fitment having a bottom surface, the fitment including a base and an integral engagement member adapted to removably engage a handle; a sponge having top and bottom surfaces, the sponge top surface being secured to the fitment bottom surface; and a scrim having top and bottom surfaces, the scrim top surface being secured to the sponge bottom surface, the scrim including a dispersible cleaning composition, the cleaning head having less than a 50% increase in resistive force between the scrim and a surface during dispersion of the cleaning composition.

In yet another embodiment of the invention, the disposable cleaning head comprises a fitment having a base and an integral engagement member adapted to removably engage a handle, a sponge and a scrim having a bottom surface adapted to contact a surface, the cleaning head being adapted to angularly articulate in the range of at least 25°–35° relative to the handle without a substantial reduction in surface contact between the scrim and a surface.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION OF THE PREFERRED EMBODIMENT

Figure 1:
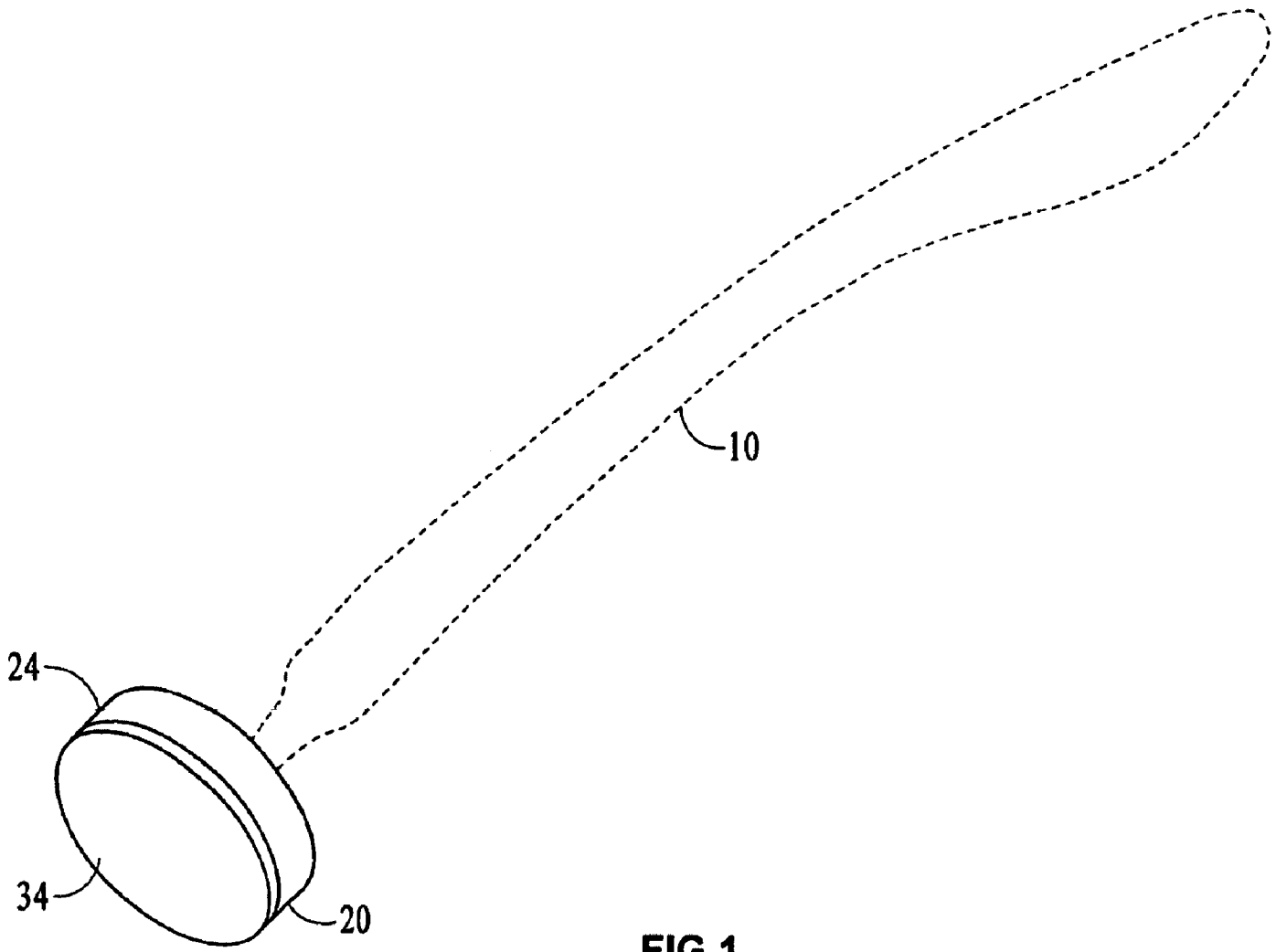
FIG. 1 is a perspective view of one embodiment of the disposable cleaning head operatively attached to a handle, according to the invention.

Before describing the present invention in detail, it is to be understood that this invention is not limited to particularly exemplified structures, compositions, systems or uses, as such may, of course, vary. It is thus to be understood that, although the invention is described in connection with the cleaning of a toilet bowl, the invention can also be readily employed to clean a variety of surfaces, such as the walls of a shower, a countertop, windows, vehicle surface(s) or a sink.

It is also to be understood that the terminology used herein is for the purpose of describing particular embodiments of the invention only, and is not intended to be limiting.

All publications, patents and patent applications cited herein, whether supra or infra, are hereby incorporated by reference in their entirety.

It must be noted that, as used in this specification and the appended claims, the singular forms "a", "an" and "the" include plural referents unless the content clearly dictates otherwise. Thus, for example, reference to "a surfactant" includes two or more such surfactants and the like.

Definitions

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In describing the present invention, the following terms will be employed and are intended to be defined as indicated below.

The term "sponge", as used herein, is meant to mean an elastic, porous material, including, but not limited to, compressed sponges, cellulosic sponges, reconstituted cellulosic sponges, cellulosic materials, foams from high internal phase emulsions, such as those disclosed in U.S. Pat. No. 6,525,106, polyethylene, polypropylene, polyvinyl alcohol, polyurethane, polyether, and polyester sponges, foams and nonwoven materials, and mixtures thereof.

The term "cleaning composition", as used herein, is meant to mean and include a cleaning formulation having at least one surfactant.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic and/or amphoteric agents. Examples of suitable surfactants include, but are not limited to, sodium lauryl sulfate, sodium xylene sulfonate, coco amine oxide, nonoxynol-9, linear alkyl naphthalene sulfonate, ethoxylated alcohol, alkyl ether sulfates, linear alkyl naphthalene, alcohol ethoxysulfates, alkyl benzene sulfonate, alpha olefin sulfonate, linear alcohol ether sulfates, linear primary alcohol ethoxylate, alkyl sulfates, alkyl aryl sulfonates, amine oxides, taurates, sarcosinates, isethionates, linear alkylbenzene sulfonates, and mixtures thereof.

As will be appreciated by one having ordinary skill in the art, the disposable cleaning head of the invention substantially reduces or eliminates the disadvantages and drawbacks associated with prior art cleaning heads and systems. In one embodiment of the invention, the disposable cleaning head generally includes a sponge, a scrim that includes a cleaning composition and a substantially flexible fitment (or cap) that facilitates bending and rotation of the cleaning head relative to the handle without the necessity of a mechanical joint.

Referring first to FIG. 1, there is shown one embodiment of the cleaning head 20 operatively connected to a handle 10 (shown in phantom). As will be appreciated by one having ordinary skill in the art, various handles that are adapted to receive the cleaning head 20 can be employed to facilitate cleaning of surfaces with the head 20.

In a preferred embodiment of the invention, the handle 10 comprises the tool assembly disclosed in co-pending application Ser. No. 10/678,033, entitled "Cleaning Tool Assembly with a Disposable Cleaning Implement", filed Sep. 30, 2003.

As set forth in the noted application, the tool assembly includes an elongated shaft having a handle portion on one end thereof. The tool assembly further includes a gripping mechanism that is mounted to the shaft and includes a contact region moveable between a gripping condition and a release condition.

In the gripping condition, the contact region of the gripping mechanism cooperates with the engagement member 46 of the cleaning head 20 (see FIG. 2) to releasably mount the cleaning head 20 to the elongated shaft. In the release condition, the cleaning head 20 is released from the gripping mechanism and thereafter disposed.

In a preferred embodiment, the tool assembly further includes a force limiting device that cooperates with the gripping mechanism to limit the engaging force applied to the engagement member of the cleaning head 20.

Figure 3:
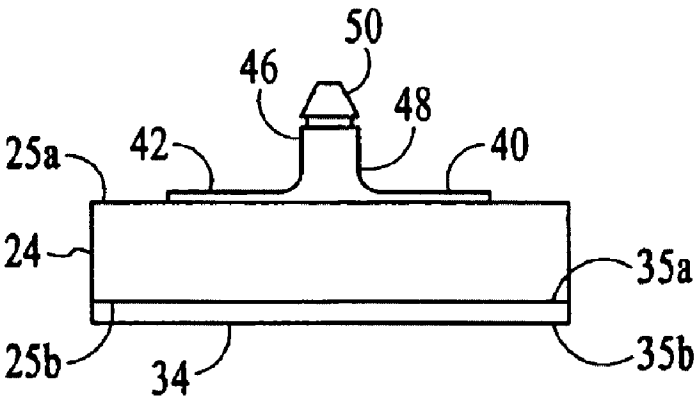
FIG. 3 is front plane view of the disposable cleaning head shown in FIG. 2.
Figure 2:
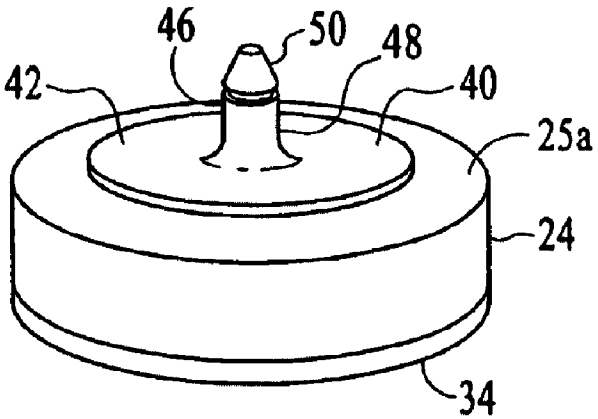
FIG. 2 is a perspective view of one embodiment of the disposable cleaning head, according to the invention.
Figure 4:
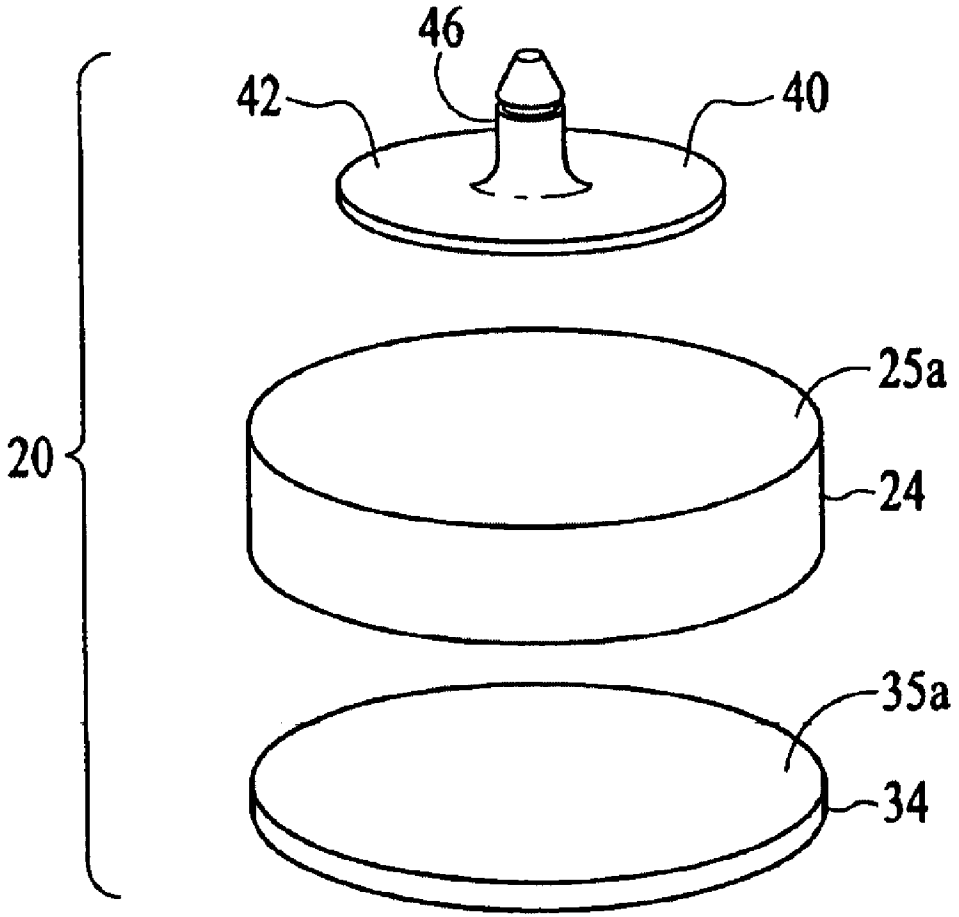
FIG. 4 is an exploded, perspective view of the disposable cleaning head shown in FIG. 2.
Figure 5B:
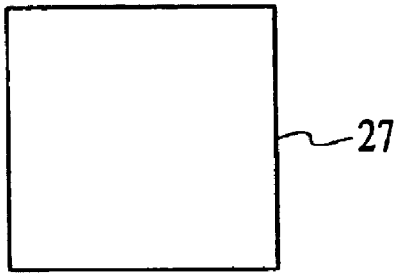
FIG. 5A-5D are top plane views of alternative shapes of the disposable cleaning head sponge, according to the invention.
Figure 5D:
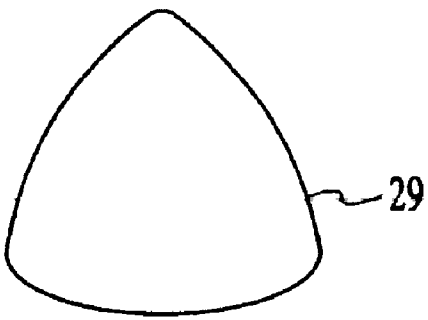
Figure 5A:
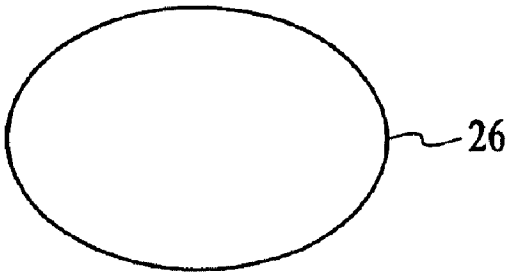
Figure 5C:
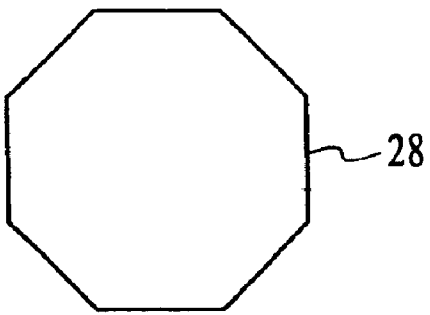

Referring now to FIGS. 2–19, the disposable cleaning head 20 of the invention will be described in detail. Referring first to FIGS. 2–4, in one embodiment of the invention, the cleaning head 20 includes a sponge 24, scrim 34 and a fitment (or top) 40. Each of the noted components is discussed in seriatim below.

Sponge

As illustrated in FIG. 2, in one embodiment of the invention, the sponge 24 is substantially disk shaped and preferably has substantially planar top 25*a* and bottom 25*b* surfaces. According to the invention, the sponge 24 can comprise various diameters (e.g., 6.0 in.) and thicknesses (e.g., 2.0 in.).

In a preferred embodiment, the sponge 24 has a diameter in the range of approximately 1.0–6.0 in., more preferably, in the range of approximately 2.75–3.25 in. and a thickness in the range of approximately 0.5–3.0 in., more preferably, in the range of approximately 0.70–0.80 in.

As will be appreciated by one having ordinary skill in the art, the sponge 24 and, hence, cleaning head 20 can also comprise various alternative shapes. Illustrative are the oval 26, square 27, octagonal 28 and triangular (or "iron") 29 shaped sponges shown in FIGS. 5A–5D. Preferably, the noted sponges are less than 10.0 in., more preferably, less than 4.0 in. in the longest planar direction (i.e., maximum planar dimension).

According to the invention, the sponge 24 can comprise a cellulosic sponge, reconstituted cellulosic sponge, cellulosic material, a foam produced from a high internal phase emulsion, such as those disclosed in U.S. Pat. No. 6,525,106, polyethylene, polypropylene, polyvinyl alcohol, polyurethane, polyether, and a polyester sponge, foam and nonwoven material, and like materials. More preferably, the sponge 24 comprises polyurethane or cellulose. Even more preferably, the sponge 24 comprises polyurethane.

Preferably, the polyurethane sponge 24 has a density in the range of 0.8–1.5 lb/ft$^3$ and an indentation force deflection ("IFD"), i.e., stiffness, in the range of approximately 10–60 lb/50 in$^2$, more preferably, in the range of approximately 24–40 lb/50 in$^2$. Applicants have found that a polyurethane sponge 24, having the noted preferred characteristics, exhibits sufficient stiffness to maintain optimum surface contact during use. The noted polyurethane and, hence, sponge 24 also exhibits excellent elastic memory, i.e., tendency to spring back to its original shape after deformation.

The sponge 24 also has an open pore structure, having an average pore size preferably in the range of approximately 3–110 pores/linear inch, more preferably, in the range of approximately 40–80 pores/linear inch. Applicants have found that the noted pore size is sufficient to facilitate the desired "foaming action" of the cleaning composition that is achieved by virtue of the mechanical action (i.e., squeezing) of the sponge 24 and/or scrim 34. The noted pore size and structure also substantially inhibits dripping of the toilet bowl water and/or solution when the cleaning head 20 is removed from the toilet bowl.

Scrim

Figure 6:
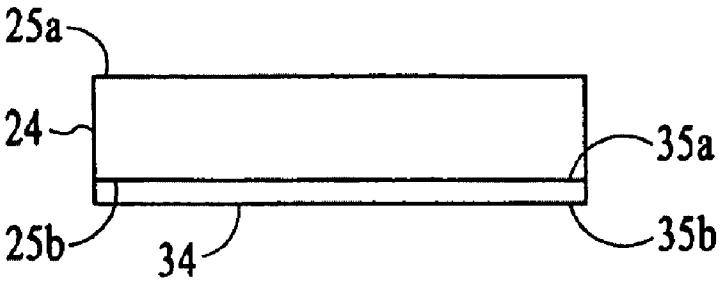
FIG. 6 is a further front, plane view of the sponge/scrim assembly shown in FIG. 2.

Referring now to FIGS. 4 and 6, there is shown one embodiment of the scrim 34. As illustrated in FIG. 6, the scrim 34 similarly, preferably includes substantially planar top 35*a* and bottom 35*b* surfaces and is preferably secured to one surface (e.g., 25*b*) of the sponge 24. In additional envisioned embodiments of the invention, one or both of the scrim 34 surfaces 35*a*, 35*b* can include a desired surface topography, such as included pleaded, creped and other uneven surface(s).

As will be appreciated by one having ordinary skill in the art, various conventional bonding means (and mediums) can be employed to secure the scrim 34 to the sponge 24. Such means include adhesives, such as hot-melt adhesives, glues, co-forming the layers, double sided adhesive films, thermal bonding and ultrasonic bonding. The scrim 34 may also be removably attached to the sponge 24, for example, by a hook and loop attachment mechanism. In a preferred embodiment, the scrim 34 is secured to the sponge 24 by conventional hot-melt bonding.

Figure 16:
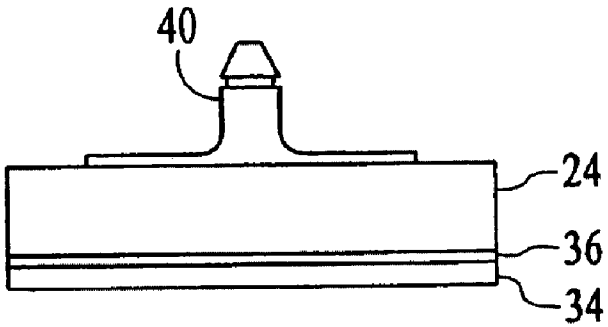
FIG. 16 is a front plane view of an alternative embodiment of the disposable cleaning head having an enhanced bonding region disposed between the sponge and scrim, according to the invention.

Referring to FIG. 16, in an alternative embodiment of the invention, a bonding medium, such as a glue, is employed to secure the scrim 34 to the sponge 24. According to the invention, the noted bonding medium provides a substantially rigid layer 36 between the sponge 24 and scrim 34, which can comprise various thicknesses and planar orientations (e.g., thinner near edge) to selectively enhance the rigidity of the sponge/scrim assembly.

In an alternative envisioned embodiment of the invention, not shown, a separate, substantially rigid member (e.g., polyethylene disk) can be disposed between the sponge 24 and scrim 34 to similarly enhance the rigidity of the sponge/scrim assembly.

According to the invention, the scrim 34 can similarly comprise various shapes and dimensions. Preferably, each surface 35*a*, 35*b* of the scrim 34 has a surface area that comprises at least 50% of the surface area of the mating sponge surface (e.g., bottom surface 25*b*). More preferably, the scrim 34 has a substantially corresponding shape and planar surface area as the mating sponge surface.

In a preferred embodiment of the invention, the scrim 34 is similarly, substantially disk shaped and preferably has a diameter in the range of approximately 1.0–6.0 in., more preferably, in the range of approximately 2.75–3.25 in.

Figure 20:
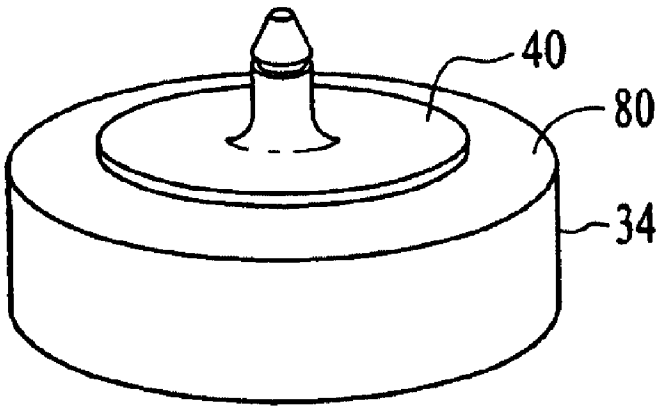
FIG. 20 is a perspective view of yet another embodiment of the disposable cleaning head, according to the invention.

The scrim 34 preferably has a thickness in the range of approximately 0.1–1.0 in. More preferably, the scrim has a thickness in the range of approximately 0.20–0.30 in. Referring to FIG. 20, if the scrim 34 is attached directly to the fitment 40, the thickness of the scrim 34 can be greater than 1.0 in.

According to the invention, the scrim 34 preferably has a tensile strength in the range of approximately 2.0–20.0 $lb/in^2$, more preferably, in the range of approximately 4.0–15.0 $lb/in^2$ in the machine direction. After the cleaning composition (discussed below) has been applied to or impregnated in the scrim 34, the scrim preferably has a tensile strength in the range of approximately 2.0–20.0 $lb/in^2$, more preferably, in the range of approximately 4.0–10.0 $lb/in^2$ in the machine direction.

Figure 7:
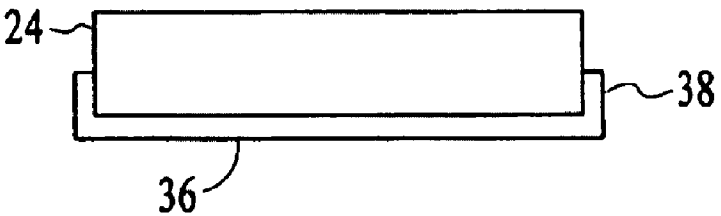
FIG. 7 is a front plane view of a sponge/scrim assembly, illustrating an alternative embodiment of a scrim, according to the invention.

Referring now to FIG. 7, there is shown a further embodiment of a scrim 36. As illustrated in FIG. 7, in the noted embodiment, the scrim 36 includes a circumferential wall 38 that projects from the top surface. The wall 38 is preferably designed and shaped to mate with the outer edge of the sponge 24 and is similarly, preferably bonded thereto by conventional hot-melt bonding.

According to the invention, the scrim 34 is preferably nonwoven, comprising fibers in the range of 0.1–30.0 denier and includes at least one of the following materials: cellulosic materials, polyethylene, polypropylene, polyester, polyamide and like materials. More preferably, the scrim 34 comprises the following composition: 100% polyester, air laid with binder, blend of 6 and 5 denier fibers having a basis weight of approximately 2.1 $oz/yd^2$, which is available from BBA Nonwovens (Nashville, Tenn.).

Cleaning Composition

In a preferred embodiment of the invention, the scrim 34 includes a cleaning composition. According to the invention, the cleaning composition can be applied to or impregnated in the scrim 34.

Preferably, the cleaning composition includes at least one surfactant and, optionally, other components. According to the invention, the surfactant can comprise anionic, nonionic, cationic and/or amphoteric agents either alone or in various combinations. Suitable surfactants include, but are not limited to, sodium lauryl sulfate, sodium xylene sulfonate, coco amine oxide, nonoxynol-9, linear alkyl naphthalene sulfonate, ethoxylated alcohol, alkyl ether sulfates, alcohol ethoxysulfates, alkyl benzene sulfonate, alpha olefin sulfonate, linear alcohol ether sulfates, linear primary alcohol ethoxylate, alkyl sulfates, alkyl aryl sulfonates, amine oxides, taurates, sarcosinates, isethionates, linear alkylbenzene sulfonates, and mixtures thereof.

Other preferred anionic surfactants include linear alkyl naphthalene sulfonate, which is available under the trade designation Petro 22 from the Petrochemicals Company, Inc., and linear primary alcohol ethoxylatc, which is available under the trade designation Neodol 45-13 from the Shell Chemical Company. All of the above surfactants are available in dry form and have very good detergency, wetting foaming and emulsifying properties.

In a preferred embodiment of the invention, the surfactant comprises sodium lauryl sulfate, sodium xylene sulfonate or coco amine oxide and/or mixtures thereof.

The surfactant(s) preferably comprises approximately 1.0–100.0 wt. % of the cleaning composition. More preferably, the surfactant comprises 5.0–90.0 wt. % of the cleaning composition.

According to the invention, the cleaning composition can also include one or more bactericidal agents, bleaching agents, chelants, salts, coloring agents, preservatives and fragrances. Suitable bactericidal agents include, but are not limited to, a quaternary ammonium compound, such as N-alkyldimethylbenzylammonium chloride (Barquat® MB-50 from Lonza), a phenolic biocide, such as 2-benzyl-4-chlorophenol (Nipacide® from Clariant), as well as peroxides, halogenated compounds, such as sodium dichloroisocyanurate, dihydrate, alkali metal or alkaline earth metal hypochlorites, hypochlorite addition products, chloramines chlorimines, chloramides, chlorimides, heterocyclic N-Bromo and N-Chloro cyanurates, halogenated hydantoins, halogenated melamines, and inorganic hypohalite releasing agents. Non-limiting examples of quaternary ammonium compounds include benzalkonium chlorides and/or substituted benzalkonium chlorides, di($C_6$—$C_{14}$) alkyl di short chain ($C_{1-4}$ alkyl and/or hydroxyalkl) quaternaryammonium salts, N-(3-chloroallyl) hexaminium chlorides, benzethonium chloride, methybenzethonium chloride, and cetylpyridinium chloride. Other quaternary compounds include dialkyldimethyl ammonium chlorides, alkyl dimethybenzylammonium chlorides, dialkylmethybenzlammonium chlorides, and mixtures thereof. Biguanide antimicrobial actives including, but not limited to, polyhexamethylene biguanide hydrochloride, p-chlorophenyl biguanide; 4-chlorobenzhydryl biguanide, halogenated hexidine such as, but not limited to, chlorohexidine (1,1'-hexamethylene-bis-5-(4-chlorophenyl biguanide) and its salts. The bactericidal agent can further comprise mixtures of the noted actives and compounds.

Preferably, the bactericidal agent comprises at least one of the following: a quaternary ammonium compound, a phenolic biocide and mixtures thereof.

As will be appreciated by one having ordinary skill in the art, the noted bactericidal agents reduce odor causing bacteria and, if employed, preferably comprise in the range of approximately 0.01–10.0 wt. %, more preferably, in the range of approximately 1.0–8.0 wt. % of the cleaning composition.

Suitable chelants include, but are not limited to, salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, citric acid and mixtures thereof. The noted chelants can also exist either partially or totally in the hydrogen ion form.

In a preferred embodiment, the chelant comprises alkali metal salts of ethylenediamine tetraacetic acid, such as Versene® K4 available from Dow Chemical Company.

The chelant, if employed, preferably comprises in the range of approximately 0.5–80.0 wt. %, more preferably, in the range of approximately 1.0–10.0 wt. % of the cleaning composition.

Suitable salts include, but are not limited to, alkali metal and alkaline earth salts of mineral acids, sodium sulfate, silicate, metasilicate, polysilicate, borate, hydroxide, carbonate, carbamate, phosphate, polyphosphate, pyrophosphates, triphosphates, tetraphosphates. In a preferred embodiment, the salt comprises sodium sulfate.

The salt, if employed, preferably comprises in the range of approximately 1.0–50.0 wt. %, more preferably, in the range of approximately 1.0–20.0 wt. % of the cleaning composition.

Suitable bleaching agents include, but are not limited to, hypohalite sources (e.g., dichloroisocyanurate), peracids, sodium percarbonate, sodium perborate, sodium persulfate, potassium persulfate, and mixtures thereof. The bleaching agent, if employed, preferably comprises in the range of approximately 1.0–40.0 wt. %, depending upon its compatibility with the particular bactericidal agent utilized.

Suitable coloring agents include, but are not limited to, FD & C Blue No. 1, FD & C Yellow No. 5 and FD & C Red No. 40. Preferably, the coloring agent comprises FD & C Blue No. 1, which is a water soluable blue dye that provides an attractive clear blue color to the water in the toilet bowl upon dissolving of composition.

In a preferred embodiment of the invention, the coloring agent is dispersed within a few seconds after immersion in the water and achieves an equilibrium color change within approximately 30 seconds thereafter. Preferably, the coloring agent is also substantially dispersed substantially coincident with substantial dispersion of the cleaning composition and, hence, effectiveness thereof.

The coloring agent, if employed, preferably comprises in the range of approximately 0.001–0.3 wt. % of the cleaning composition.

Suitable acid/base stabilized fragrances include, but are not limited to, lemon, citrus or pine. The fragrance or other volatile additive is optionally in an encapsulated or bound form, such as capsules, starch granules, cyclodextrin complexes, or as a chemically modified pro-fragrance. The fragrance, if employed, preferably comprises in the range of approximately 0.1–30.0 wt. % of the cleaning composition.

In one embodiment of the invention, the cleaning composition preferably comprises a combination of an anionic surfactant, such as sodium lauryl sulfate, and a nonionic surfactant, such as an alkyl ethoxylate and propoxylate, ethoxylate/propoxylate block copolymer, alkyl polyglycoside and alkanolamide. In a further embodiment, the cleaning composition comprises a combination of a surfactant, fragrance, coloring agent and a preservative.

The unique synergism between the sponge 24, scrim 34 and cleaning composition of the invention provides optimum lubricity (i.e., lack of drag) during use and while the cleaning composition is being dispensed. Indeed, Applicants have found that there is less than a 50% increase in the resistive (or frictional) force between the scrim 34 and a surface to and until the cleaning composition is fully dispensed.

Fitment

A key component of the disposable cleaning head 20 of the invention is the fitment 40. According to the invention, the fitment 40 is designed and constructed to facilitate rotation and/or bending of the fitment 40 and, hence, head 20 relative to the handle 10. Indeed, by virtue of the uniquely designed flexible fitment engagement member 46 (discussed below) and the material characteristics (e.g., compressibility) of the sponge 24 and scrim 34, the cleaning head 20 can facilitate angular (and rotational) articulation relative to the handle 10 in the range of at least 25°–35° (denoted "α" in FIG. 15), without a substantial reduction in surface contact between the scrim 34 and a surface 5.

The fitment 40 is further designed and adapted to cooperate with the gripping mechanism of the handle 10 (or tool assembly), whereby when the gripping mechanism is in a gripping condition the fitment 40 is able to withstand axial forces in the range of at least approximately 1.0–30.0 lbs. before the fitment 40 and, hence, cleaning head 20 becomes disengaged from the gripping mechanism and, hence, handle 10.

Preferably, the fitment 40 is constructed out of polyethylene, polypropylene or a like elastomeric material. More preferably, the fitment 40 is constructed out of low density polyethylene.

Figure 10:
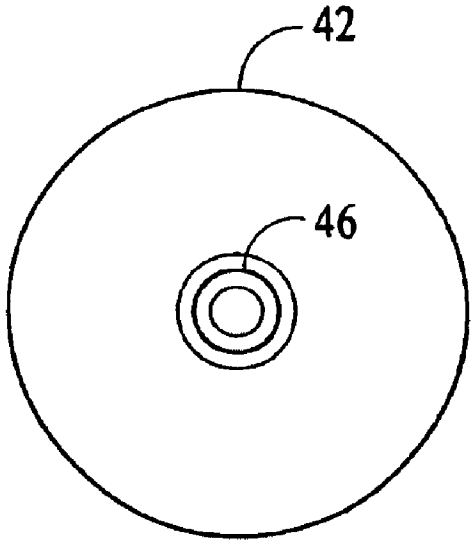
FIG. 10 is a top plane view of the fitment shown in FIG. 9.

Referring to FIGS. 2 and 3, the fitment 40 preferably includes a substantially planar base 42 and an engagement member 46 that extends from the top surface 43 of the base 42. As illustrated in FIGS. 2 and 10, in one embodiment of the invention, the base 42 is substantially disk shaped. Preferably, the fitment 40 has a diameter that is in the range of approximately 20–100% of the outer diameter of the sponge 24. More preferably, to provide functionality in cleaning, the fitment 40 preferably covers in the range of approximately 30–80% of the surface area of the sponge 24 or scrim 34 when secured thereto.

In one embodiment of the invention, the base 42 has a diameter in the range of approximately 0.5–6.0 in., more preferably, in the range of approximately 1.0–4.0 in. Even more preferably, the base 42 has a diameter of approximately 2.0 in.

Preferably, the base has a variable thickness; in the range of approximately 0.055–0.085 in. proximate the center region and in the range of approximately 0.010–0.050 in. proximate the outer edge. In an alternative embodiment of the invention, the base 42 has a substantially uniform thickness in the range of approximately 0.010–0.100 in., more preferably, in the range of approximately 0.040–0.080 in.

Figure 12:
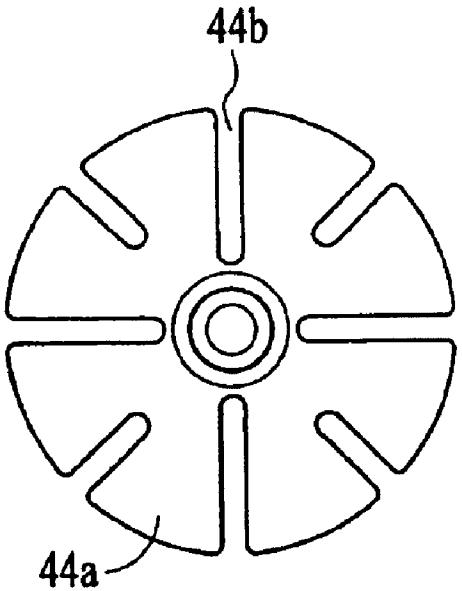
FIG. 12 is a top plane view of another embodiment of a fitment having a plurality of slots, according to the invention.
Figure 11:
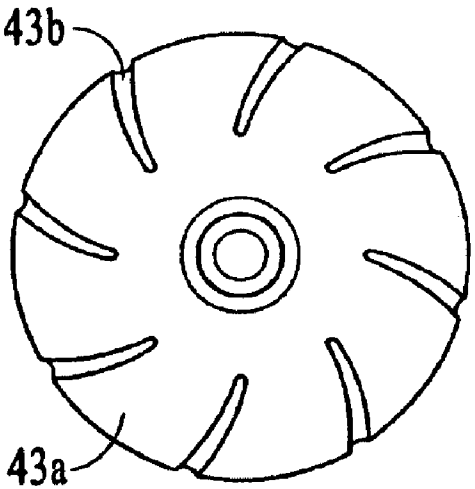
FIG. 11 is a top plane view of an alternative embodiment of a fitment having a plurality of vanes, according to the invention.

According to the invention, the base 42 can comprise various shapes, such as the alternative sponge shapes shown in FIGS. 5A–5D, and/or include design features, such as one or more flexible zones (e.g., vanes, slots, etc.), to tailor the flexibility of the base 42 and, hence, fitment 40. Referring to FIG. 11, by way of illustration, the base 43*a* can include at least one, more preferably, a plurality of vanes 43*b* disposed on at least one surface thereof. Alternatively, as illustrated in FIG. 12, the base 44*a* can include one or more slots 44*b* having similar or dissimilar lengths and/or widths.

Figure 15:
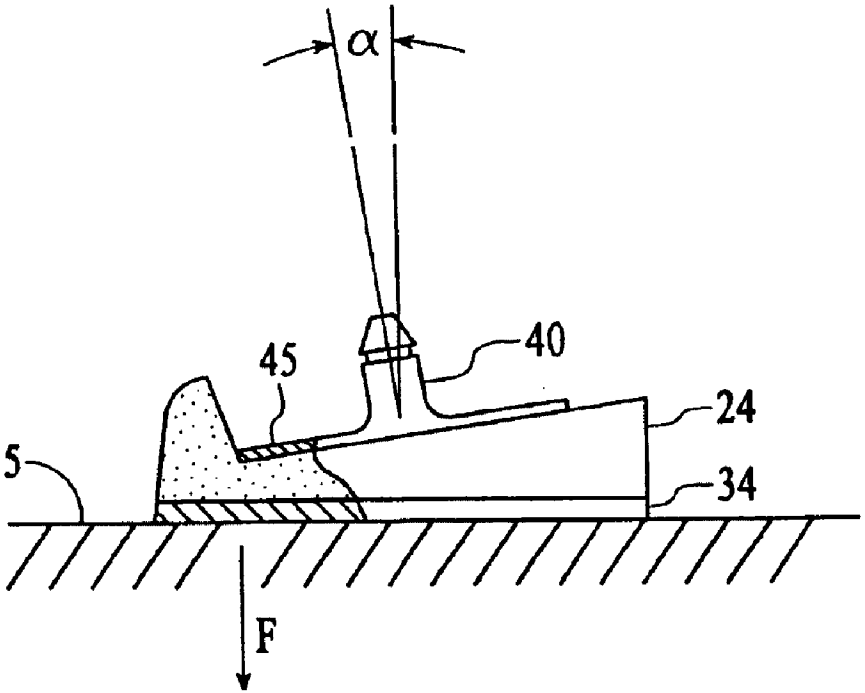
FIG. 15 is a schematic illustration of the disposable cleaning head, illustrating an induced cleaning force proximate the edge of the fitment, according to the invention.

Referring to FIG. 15, by tailoring the flexibility of the base 42 and, hence, peripheral edge 45 thereof, a user can induce an enhanced scrubbing force (designated by Arrow F) and region proximate the edge 45.

Figure 9:
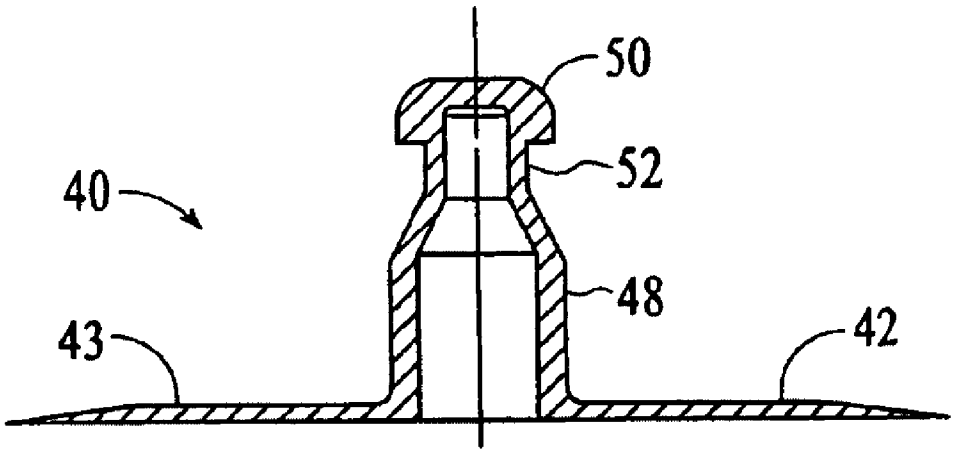
FIG. 9 is a section, front plane view of one embodiment of a fitment, according to the invention.
Figure 8:
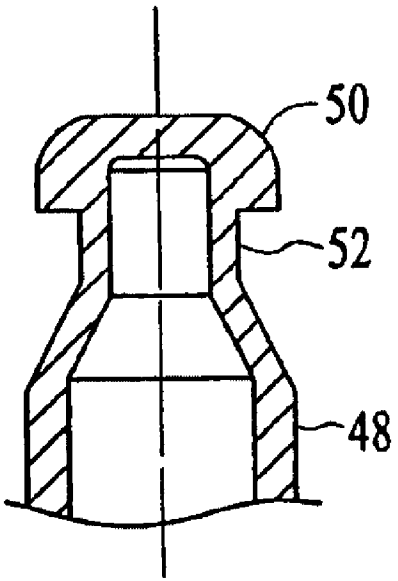
FIG. 8 is a partial section, front plane view of one embodiment of the fitment engagement member, according to the invention.

Referring now to FIGS. 8 and 9, the engagement member 46 preferably includes an elongated base 48, conical shaped head 50 and a recessed retainer region 52 adapted to receive the gripping mechanism of the tool assembly or handle 10 and be readily disconnectable therefrom. As stated, the noted engagement member 46 is further adapted to cooperate with the gripping mechanism of the tool assembly, whereby when the gripping mechanism is in a gripping condition the fitment 40 is able to withstand axial forces in the range of at least approximately 1.0–30.0 lbs. before the fitment 40 and, hence, cleaning head 20 becomes disengaged from the gripping mechanism.

Figure 14:
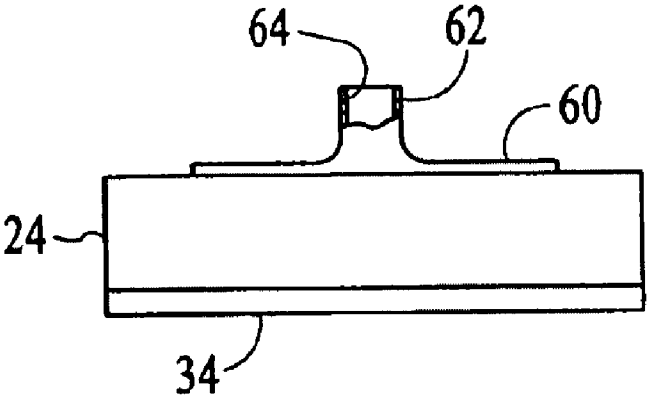
FIG. 14 is front, plane view of the disposable cleaning head shown in FIG. 13.
Figure 13:
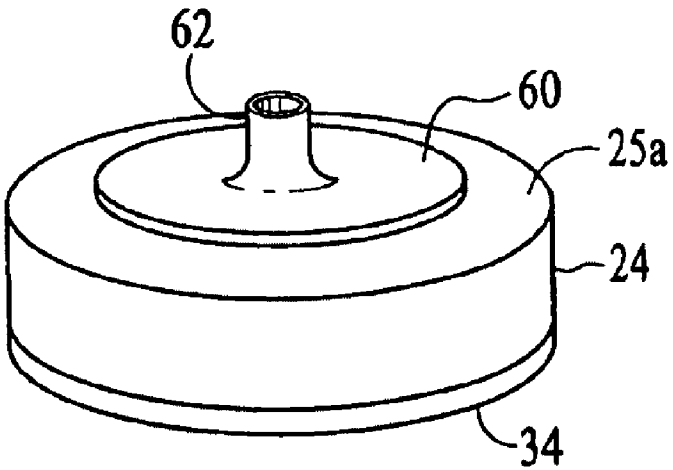
FIG. 13 is a perspective view of an alternative embodiment of the disposable cleaning head, according to the invention.

Referring now to FIGS. 13 and 14, in an alternative embodiment, the fitment 60 includes an engagement member 62 having an internal lumen or slot 64 that is adapted to engage a tool assembly or handle 10 having a male gripping member component. Such a tool assembly is disclosed in co-pending application Ser. No. 10/602,478, entitled "CLEANING TOOL WITH GRIPPING ASSEMBLY FOR A DISPOSABLE SCRUBBING HEAD", filed Jun. 23, 2003.

Figure 17:
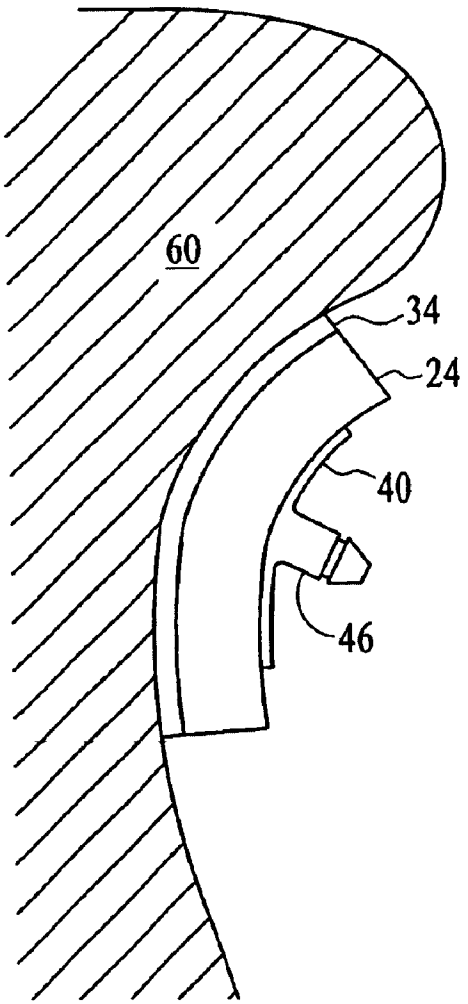
FIG. 17 is a schematic illustration of the disposable cleaning head in contact with a curved surface of a toilet bowl, according to the invention.

As indicated, a key feature of the fitment 40 and, hence, cleaning head 20, is the ability of the fitment 40 to bend and/or rotate about its axis. Referring now to FIG. 17, the noted design feature facilitates placement of the cleaning head 40 into curvatures of the toilet bowl 100 while maintaining optimum surface contact between the scrim 34 and toilet bowl 100.

Figure 19:
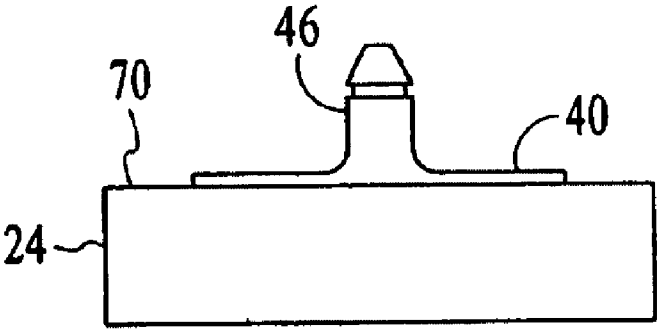
FIG. 19 is a front plane view of the disposable cleaning head shown in FIG. 18.
Figure 18:
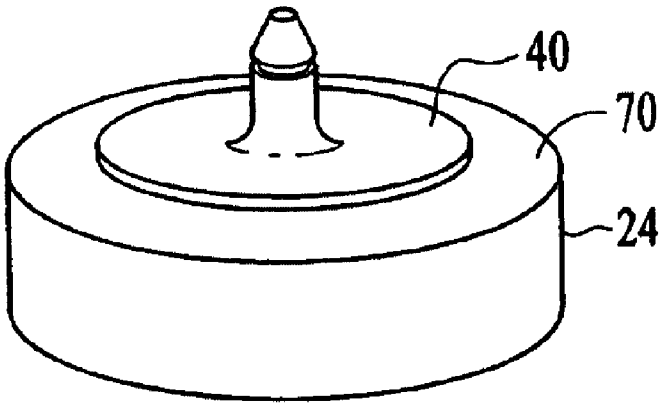
FIG. 18 is a perspective view of a further embodiment of the disposable cleaning head, according to the invention.

Referring now to FIGS. 18 and 19, there is shown a further embodiment of a disposable cleaning head 70. As illustrated in FIG. 18, in the noted embodiment, the cleaning head merely includes a sponge 24 that is secured to the fitment 40. The sponge 24 can, and in a preferred embodiment does, include a cleaning composition. According to the invention, the sponge 24 can be impregnated with the cleaning composition or the cleaning composition can be disposed on the open surface of the sponge 24.

Figure 21:
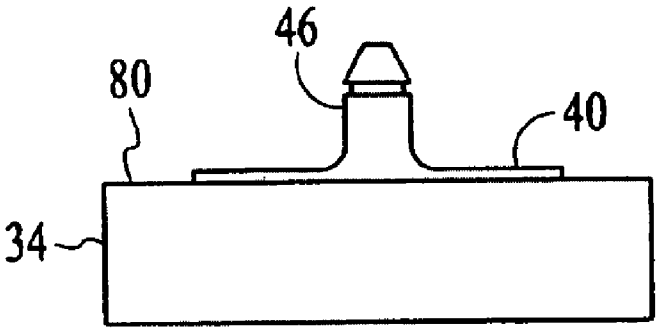
FIG. 21 is a front plane view of the disposable cleaning head shown in FIG. 20.

Referring now to FIGS. 20 and 21, there is shown yet another embodiment of a disposable cleaning head 80. As illustrated in FIG. 20, in this embodiment, the cleaning head merely includes a scrim 34 that is secured to the fitment 40. The scrim 34 can, and in a preferred embodiment does, include a cleaning composition. According to the invention, the scrim 34 can be impregnated with the cleaning composition, as described above, or the cleaning composition can be disposed on the open surface of the scrim 34.

In alternative envisioned embodiments of the invention, the sponge 24, scrim 34 or both can be water dispersible or water soluble.

EXAMPLES

The present invention is further illustrated by the following example. The example is for illustrative purposes only and thus should not be construed as limiting the invention in any way.

All scientific and technical terms employed in the example have the same meanings as understood by one with ordinary skill in the art. Unless specified otherwise, all component or composition percentages are "by weight", e.g., 30 wt. %.

Example 1

The following cleaning compositions were evaluated for maximum foam height and residual foam height as 0.2% active solution in water: Amphosol CS 50 (amphoteric surfactant from Stepan Company); Stepanol MG (magnesium lauryl sulfate from Stepan Company); Ammonyx CETAC 30 (cationic surfactant from Stepan Company); Stepanol WA-Extra (sodium lauryl sulfate from Stepan Company); 60% Stepanol WA-Extra/40% Fragrance; Ninol 96SL (lauryl diethanolamide from Stepan Company); and Bardac 205 M (quaternary surfactant from Lonza).

The test procedure comprised adding 100 ml of the 0.2% solution to a 500 ml graduated cylinder. The graduated cylinder was then inverted 10 complete cycles and the foam evaluated after 15 seconds by taking a reading of maximum foam height in ml, including the base of the 100 ml of liquid. A second reading was taken after 5 minutes to determine the stability of the foam (residual foam height in ml). Cleaning compositions having a maximum foam height or residual foam height less than 200 ml were deemed unacceptable.

The results of the noted test are set forth in Table I.

TABLE I

| Cleaning Composition | Maximum Foam (ml) | Residual Foam (ml) |
|---|---|---|
| Amphosol CS 50 | 325 | 325 |
| Stepanol MG | 405 | 400 |
| Ammonyx CETAC 30 | 375 | 360 |
| Stepanol WA-Extra | 475 | 375 |
| 60% Stepanol WA Extra/ 40% Fragrance | 400 | 390 |
| Ninol 96SL | 195 | 195 |
| Bardac 205 M | 200 | 100 |

As reflected in Table I, with the exception of the Ninol 96SL and Bardac 205 M cleaning compositions, each of the noted compositions had maximum and residual foam heights greater than 200 ml.

As one having ordinary skill in the art will readily ascertain and appreciate, the above described invention provides numerous advantages, including the provision of a disposable cleaning head and system that:

- substantially enhances the effectiveness of cleaning a toilet bowl as compared to prior art brush and sponge systems;
- substantially reduces the cleaning time of a toilet bowl;
- is readily engagable to and releasable from a variety of handles;
- includes a flexible engagement member that facilitates bending in multiple planes and rotation of the cleaning head relative to the handle without the necessity of a mechanical joint;
- includes a predetermined amount of cleaning composition that effectively cleans and disinfects a toilet surface; and
- has sufficient flexibility to maintain optimum surface contact during use on curved surfaces and/or constrained toilet bowl regions.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

What is claimed is:

1. A cleaning tool comprising:

a. an elongated handle; and b. a cleaning head comprising:

i. a flexible fitment having a bottom surface, said fitment including a base and an integral engagement member adapted to removably engage the handle, the engagement member extending from and substantially perpendicular to an upper surface of the base;

ii. a sponge having top and bottom surfaces, the sponge top surface being secured to the fitment bottom surface; and iii. a scrim having top and bottom surfaces, the scrim top surface being secured to the sponge bottom surface, the scrim including a dispersible cleaning composition;

iv. the handle being coupled to the engagement member such that an axis of the engagement member and the longitudinal axis of the handle are generally aligned and wherein this alignment of the two axes is fixed during use of the cleaning tool, the cleaning head further being adapted to angularly articulate in the range of at least 25°–35° relative to said handle without a substantial reduction in surface contact between said scrim and the surface being cleaned; and v. the cleaning head being adapted to rotationally articulate relative to the handle about an axis coincident with the engagement member and handle axis.

2. The cleaning tool of claim 1, wherein the scrim includes at least one material selected from the group consisting of cellulose, polyethylene, polypropylene, polyester and polyamide.

3. The cleaning tool of claim 1, wherein the scrim comprises substantially non-woven fibers.

4. The cleaning tool of claim 1, wherein the scrim has a thickness in the range of approximately 0.5–1.0 in.

5. The cleaning tool of claim 1, wherein the scrim has a tensile strength in the range of approximately 2.0–20 lb/in$^2$.

6. The cleaning tool of claim 1, wherein the cleaning composition is dispersible in water.

7. The cleaning tool of claim 6, wherein the cleaning head has less than a 50% increase in resistive force between the scrim and the surface to be cleaned during dispersion of the cleaning composition.

8. A cleaning tool comprising:

a. an elongated handle; and b. a cleaning head comprising:

i. a flexible fitment having a bottom surface, said fitment including a base and an integral engagement member adapted to removably engage the handle, the engagement member extending from and substantially perpendicular to an upper surface of the base; and ii. a scrim having top and bottom surfaces, the scrim top surface being secured to the fitment bottom surface, the scrim including a dispersible cleaning composition;

iv. the handle being coupled to the engagement member such that an axis of the engagement member and the longitudinal axis of the handle are generally aligned and wherein this alignment of the two axes is fixed during use of the cleaning tool, the cleaning head further being adapted to angularly articulate in the range of at least 25°–35° relative to said handle without a substantial reduction in surface contact between said scrim and the surface being cleaned; and v. the cleaning head being adapted to rotationally articulate relative to the handle about an axis coincident with the engagement member and handle axis.

9. The cleaning tool of claim 8, wherein the scrim includes at least one material selected from the group consisting of cellulose, polyethylene, polypropylene, polyester and polyamide.

10. The cleaning tool of claim 8, wherein the scrim comprises substantially non-woven fibers.

11. The cleaning tool of claim 8, wherein the scrim has a thickness in the range of approximately 0.5–1.0 in.

12. The cleaning tool of claim 8, wherein the scrim has a tensile strength in the range of approximately 2.0–20 lb/in$^2$.

13. The cleaning tool of claim 8, wherein the cleaning composition is dispersible in water.

14. The cleaning tool of claim 13, wherein the cleaning head has less than a 50% increase in resistive force between the scrim and the surface to be cleaned during dispersion of the cleaning composition.

15. A cleaning tool comprising:

a. an elongated handle; and b. a cleaning head comprising:

i. a flexible fitment having a bottom surface, said fitment including a base and an integral engagement member adapted to removably engage the handle, the engagement member extending from and substantially perpendicular to an upper surface of the base;

ii. a sponge having top and bottom surfaces, the sponge top surface being secured to the fitment bottom surface;

iv. the handle being coupled to the engagement member such that an axis of the engagement member and the longitudinal axis of the handle are generally aligned and wherein this alignment of the two axes is fixed during use of the cleaning tool, the cleaning head further being adapted to angularly articulate in the range of at least 25°–35° relative to said handle without a substantial reduction in surface contact between said scrim and the surface being cleaned; and v. the cleaning head being adapted to rotationally articulate relative to the handle about an axis coincident with the engagement member and handle axis.

16. The cleaning tool of claim 15, wherein the sponge has a thickness in the range of approximately 0.5–1.0 in.

17. The cleaning tool of claim 15, wherein the sponge has a stiffness in the range of approximately 10–60 lb/50 in$^2$.

18. The cleaning tool of claim 15, wherein the head includes a water-dispersible cleaning composition.

19. The cleaning tool of claim 18, wherein the cleaning head has less than a 50% increase in resistive force between the sponge and the surface to be cleaned during dispersion of the cleaning composition.

* * * * *